US005627573A

United States Patent [19]

Fahy

[11] Patent Number: 5,627,573

[45] Date of Patent: May 6, 1997

[54] MAINTENANCE DEVICE IN AN INK JET PRINTING APPARATUS

[75] Inventor: Cathal L. Fahy, Memphis, Tenn.

[73] Assignee: Brother International Corporation, Somerset, N.J.

[21] Appl. No.: 368,308

[22] Filed: Jan. 4, 1995

[51] Int. Cl.[6] ..... B41J 2/165

[52] U.S. Cl. ..... 347/32; 347/29

[58] Field of Search ..... 347/29, 32

[56] References Cited

U.S. PATENT DOCUMENTS

| | | | |
|---|---|---|---|
| 4,533,927 | 8/1985 | Iwagami et al. . | |
| 4,728,970 | 3/1988 | Terasawa | 347/30 |
| 5,202,702 | 4/1993 | Terasawa et al. . | |
| 5,266,974 | 11/1993 | Koitabashi et al. | 347/33 |

FOREIGN PATENT DOCUMENTS

| | | | |
|---|---|---|---|
| 404250059 | 9/1992 | Japan | 347/29 |

*Primary Examiner*—Benjamin R. Fuller
*Assistant Examiner*—Juanita Stephens
*Attorney, Agent, or Firm*—Oliff & Berridge

[57] ABSTRACT

An ink jet printing apparatus includes a maintenance device configured to minimize the occupied space. The maintenance device includes a movable cap carriage supporting a cap and including two guide pins. The cap is engageable with an ink jet head of the ink jet printing apparatus. A cover surrounds the cap carriage and includes two guide slots receiving the two guide pins of the cap carriage, respectively. When a printing carriage engages a printing carriage engaging member of the maintenance device, the guide pins are caused to ride in the guide slots, enabling the movable cap carriage to be shifted from a recessed position to an engaged position where the cap engages the ink jet head. The two guide slots are inclined at different angles to minimize the frictional resistance during the shift from the recessed position to the engaged position. In other aspects of the invention, a spring is disposed between the movable cap carriage and a maintenance device frame and is oriented at an angle substantially corresponding to one of the guide slots to facilitate the return of the movable cap carriage from the engaged position to the recessed position. In addition, a wiper is disposed to wipe residual ink from the ink jet head, and a retaining wall is disposed adjacent the wiper to prevent the wiper from deflecting beyond a predetermined position.

16 Claims, 10 Drawing Sheets

MAINTENANCE DEVICE IN AN INK JET PRINTING APPARATUS

BACKGROUND OF THE INVENTION

1. Field of the Invention

This invention relates to a maintenance device in an ink jet printing apparatus and, in particular, to a capping mechanism and a wiper arrangement in the maintenance device.

2. Description of the Related Art

The maintenance device in an ink jet printing apparatus is generally disposed at an end of the printing apparatus. Because printing cannot be performed in the area above the maintenance device, it is advantageous to minimize the size of the maintenance device to reduce the overall size of the printing apparatus and to increase a space where printing can be performed.

A maintenance device in an ink jet printing apparatus generally performs maintenance operations to preserve the life of the ink jet head. The maintenance device includes a wiper for wiping residual ink from the nozzles of the ink jet head after completion of printing and a capping mechanism to cap the ink jet head for storage. The wiping and capping operations prevent the nozzles from becoming blocked and extend the life of the ink jet head.

One such maintenance device is described in U.S. Pat. No. 5,202,702 to Terasawa et al. (Terasawa hereinafter). Terasawa describes a method and apparatus for cleaning an ink jet recording head using a flexible blade that is moved forwardly and backwardly in response to the capping operation of the front surface of the recording head and the movement of a carriage. The front surface of the recording head is wiped by the blade in response to the movement of the carriage. A problem arises in Terasawa, however, in that the blade and capping mechanism are moved forwardly and backwardly by at least one actuator, thereby increasing the manufacturing costs of the apparatus. In addition, because of the proximity of the blade and the capping mechanism, a situation may arise where the blade is deflected by the printing carriage into the path of the capping mechanism so as to be pinched between the capping mechanism and the recording head in the standby position.

To lower the cost of the apparatus, there has been disclosed a device that operates without the use of a separate actuator for the wiping and/or capping functions. U.S. Pat. No. 4,533,927 to Iwagami et al. (Iwagami hereinafter) describes an ink jet system printer including a capping mechanism for covering a printer head when a carriage is located at a standby position. The capping mechanism includes a cap member supported by a slidable plate that is shifted toward the printer head as the printer head moves to the standby position through the use of links. The slidable plate is shifted by the traveling force of the carriage so that a separate drive source is not required. Iwagami, however, relies on the use of a large number of parts and relies on springs to perform the capping action. In addition, Iwagami does not suggest a way to reduce a size of a maintenance device including a capping mechanism and a wiper.

SUMMARY OF THE INVENTION

It is therefore an object of the present invention to provide a maintenance device for an ink jet printing apparatus that overcomes the disadvantages of the prior art.

It is another object of the invention to provide a maintenance device including a capping mechanism that is easy to position without the use of a separate actuator.

It is still another object of the invention to provide a maintenance device for an ink jet printing apparatus wherein the space occupied by the maintenance device is minimized.

These and other objects of the invention are achieved by providing a maintenance device in an ink jet printing apparatus including: a movable cap carriage supporting a cap and including first and second guide pins, wherein the cap is engageable with an ink jet head of the ink jet printing apparatus; and a guide member including first and second guide slots receiving the first and second guide pins of the cap carriage, respectively, wherein the first and second guide slots are inclined at different angles.

The cap carriage may be movable between a recessed position and an engaged position by the first and second guide pins in the first and second guide slots, wherein the first guide slot is configured such that the cap is disposed clear of a printing carriage path in the recessed position. The first guide slot may be inclined at a steeper angle than the second guide slot such that the cap carriage is shifted and rotated between the recessed position and the engaged position. The cap may be disposed substantially in alignment with the first guide pin. The movable cap carriage may further include third and fourth guide pins, and the guide member may further include third and fourth guide slots receiving the third and fourth guide pins.

The cap may be telescopically slidable in an aperture through the movable cap carriage, and a spring may be disposed between the cap and the movable cap carriage, the spring causing the cap to seal around the ink jet head with a positive capping force when the cap is engaged with the ink jet head.

According to another aspect of the invention, there is provided an ink jet printing apparatus including: a printing carriage that is movable between a maintenance area and a printing area; a maintenance device including: a cap carriage movable between a recessed position and an engaged position and supporting a cap, the cap carriage including first and second guide pins, wherein the cap covers an ink jet head of the ink jet printing apparatus in the engaged position, a printing carriage engaging member attached to the cap carriage, the printing carriage engaging member engaging the printing carriage when the printing carriage moves between the printing area and the maintenance area, and a guide member including first and second guide slots receiving the first and second guide pins of the cap carriage, respectively; and a spring, one end of the spring fixed to a stationary portion of the ink jet printing apparatus and the other end of the spring fixed to the cap carriage for movement with the cap carriage, wherein the spring is disposed at an angle substantially corresponding to an incline angle of one of the first and second guide slots.

In accordance with still another aspect of the invention, there is provided a maintenance device in an ink jet printing apparatus including a movable cap carriage supporting a cap, wherein the cap is engageable with an ink jet head of the ink jet printing apparatus, and structure for shifting the cap carriage between a recessed position and an engaged position and for reducing frictional resistance during shifting, wherein the cap covers an ink jet head of the ink jet printing apparatus in the engaged position.

The shifting and reducing structure may include at least one slot having an incline angle, at least one pin fixed to the movable cap carriage, the at least one slot receiving the pin, and a spring attachable between the movable cap carriage and a stationary portion of the ink jet printing apparatus, the spring being disposed at an angle substantially corresponding to the incline angle of the at least one slot.

BRIEF DESCRIPTION OF THE DRAWINGS

These and other aspects and advantages of the present invention will become apparent from the following detailed description of preferred embodiments when taken in conjunction with the accompanying drawings, in which.

DETAILED DESCRIPTION OF PREFERRED EMBODIMENTS

A preferred embodiment of the invention will be described below with reference to the accompanying drawings.

Figure 1:
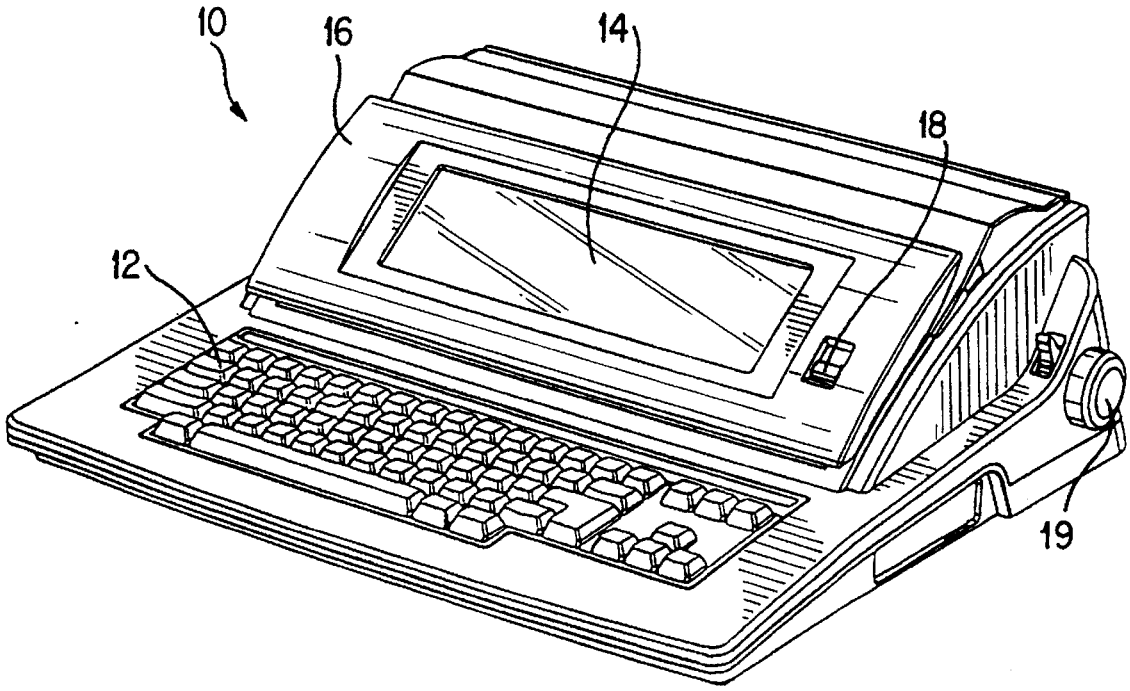
FIG. 1 is an isometric view of a printing apparatus generally showing a keyboard and a liquid crystal display.

As shown in FIG. 1, an ink jet typewriter 10 of the present invention comprises a keyboard 12 and a liquid crystal display 14 for displaying typed text before it is printed on a recording medium. The liquid crystal display 14 is mounted on a cover 16 that is pivotable to various set positions according to user preference. The pivotable panel 16 includes a control mechanism 18 for varying the light intensity and/or contrast of the liquid crystal display 14. The typewriter 10 also may include all necessary mechanisms found on conventional machines, such as a manual paper advancement knob 19.

Figure 2:
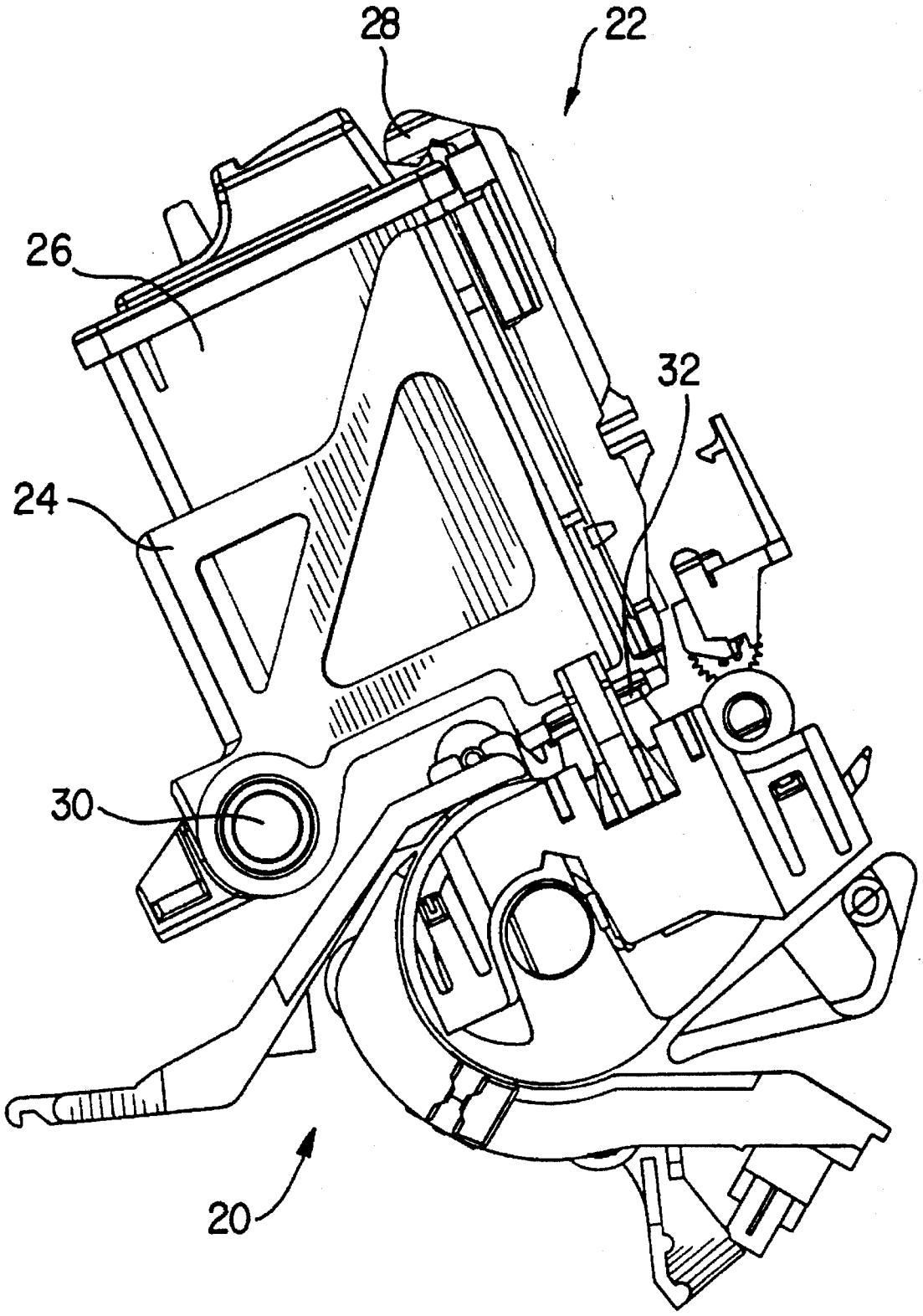
FIG. 2 is a side elevational view showing the paper conveying mechanism and ink jet carriage assembly.

FIG. 2 shows details of the paper guidance and conveying mechanism 20 in relation to the reciprocable printing mechanism 22. The reciprocable printing mechanism 22 includes a printing carriage 24 and a print cartridge 26 that is fitted onto the carriage 24 using a flexible tab mechanism 28. The carriage 24 and the cartridge 26, as an integral unit, are reciprocated along a main shaft 30. As the printing unit 22 is reciprocated along the shaft 30, a print head 32, such as an ink jet print head having ink jet nozzles, prints characters onto a recording medium (not shown), such as cut sheet paper documents or other sheet material, which may have various thicknesses. The print head 32 is formed as an integral part of the cartridge 26.

Figure 3:
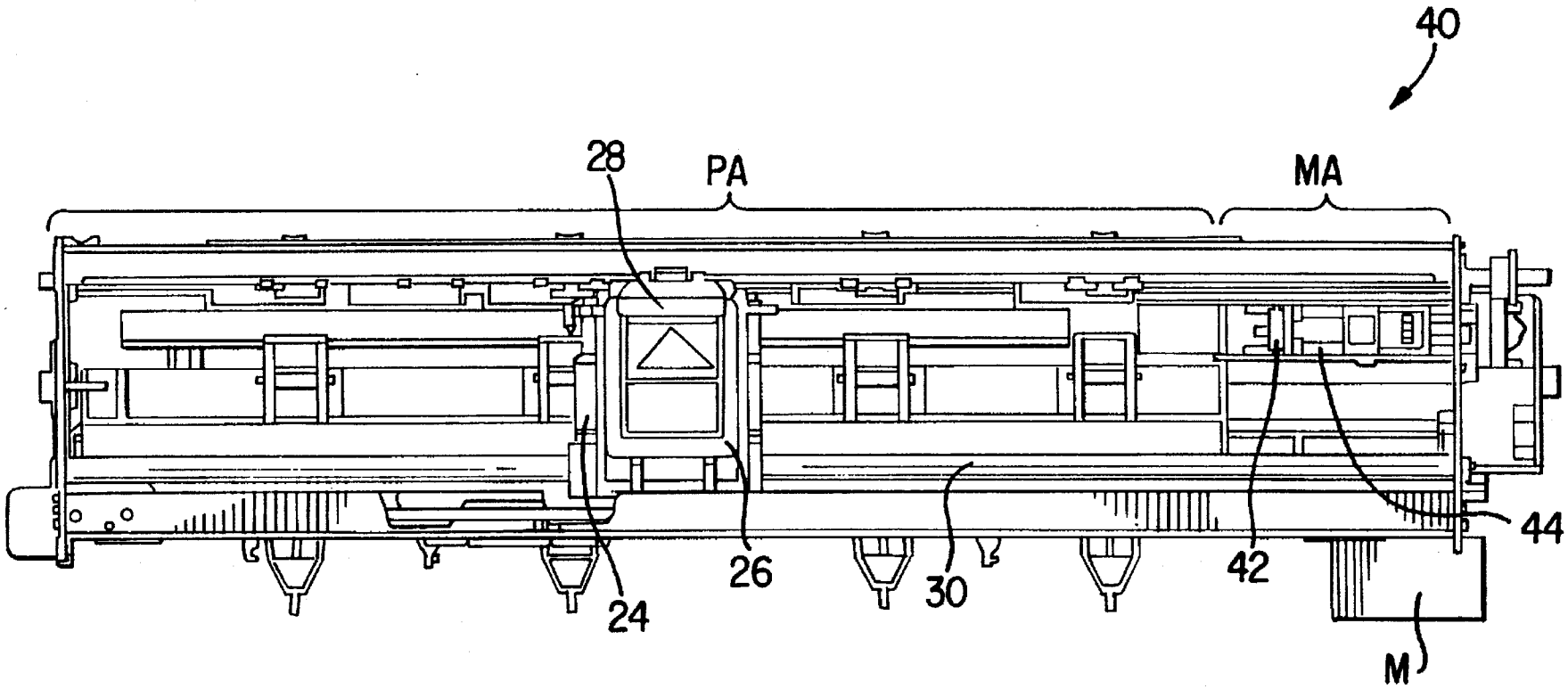
FIG. 3 illustrates a top view of the maintenance device of the present invention.
Figure 4:
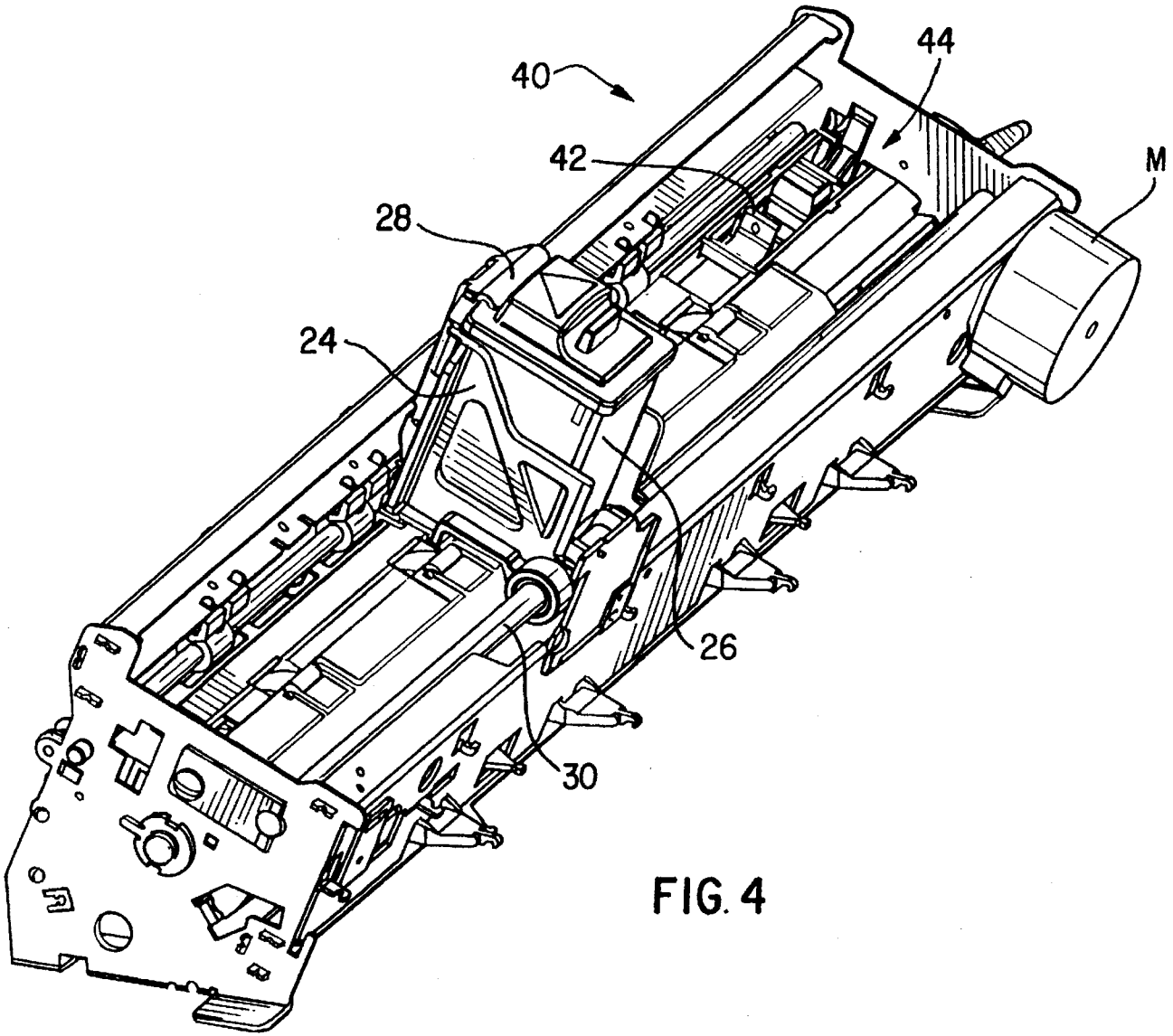
FIG. 4 is a perspective view illustrating the maintenance device.

As illustrated in FIGS. 3 and 4, the maintenance device 40 for the printing apparatus is disposed at an end of the printing carriage travel path. Because printing cannot be carried out in the maintenance area, it is desirable to minimize the size of the maintenance device to thereby minimize the size of the printing apparatus and maximize a printing area.

The printing carriage 24, during printing, is movable across a printing area PA by a driving force of a motor M transmitted by a timing belt (not shown). The printing apparatus can be of the type that prints in forward and reverse directions or either one thereof. The invention is not meant to be limited. When the printing apparatus is not being used for printing, the carriage is shifted to one end of the printing apparatus behind the printing area PA. This position is a maintenance area MA where the printing carriage 24 is disposed above the maintenance device 40. The structure of the invention enables the ink jet nozzles of the ink jet cartridge 26 to be wiped clean by a wiper 42 as the carriage 24 moves into the maintenance area and capped by a capping mechanism 44 when the printing carriage 24 is shifted from the printing area PA to the maintenance area MA.

Figure 5:
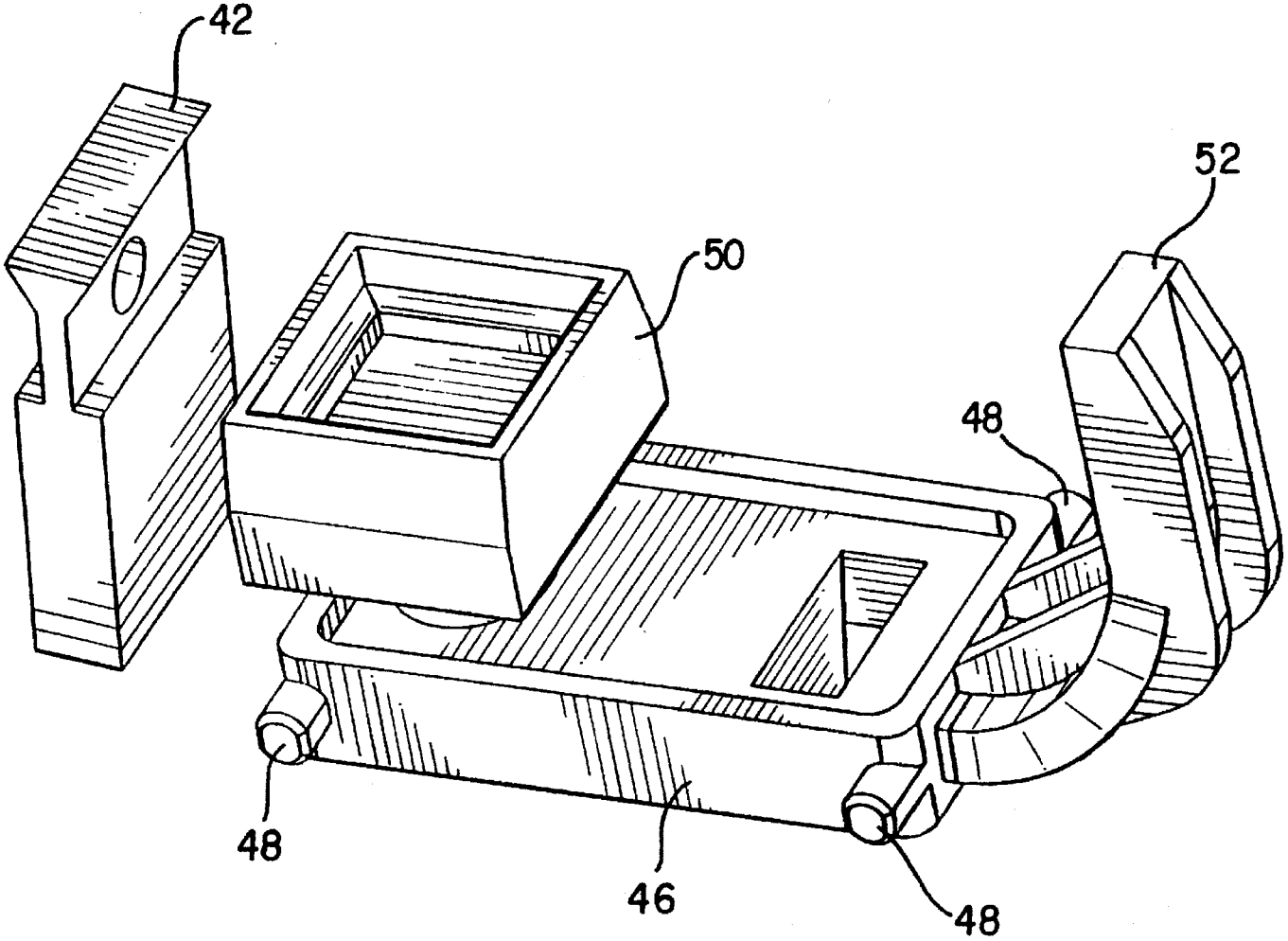
FIG. 5 is a perspective view of the components of the maintenance device.

FIG. 5 illustrates the components of the maintenance device 40. In particular, the maintenance device 40 includes a movable cap carriage 46 supporting a cap 50 and including four guide pins 48 (two pins 48 in one side of the cap carriage 46 can be seen in FIG. 5). The cap 50 is shaped to fit over the nozzles of the ink jet head 32. The maintenance device 40 also includes a wiper 42 for wiping residual ink from the nozzles of the ink jet head 32. The wiper 42 is preferably formed of a flexible material such as rubber. The wiper 42 is fixed in its position and is disposed in a traveling path of the print cartridge 26 to wipe residual ink from ink jet nozzles of the ink jet head 32 when the printing carriage 24 is moved from the printing area PA to the maintenance area MA. A printing carriage engaging member 52 is disposed at one end of the movable cap carriage 46. The printing carriage engaging member 52 engages the printing carriage 24 when the printing carriage 24 moves in the maintenance area MA and moves the cap 50 into the capping position as discussed below.

Figure 6:
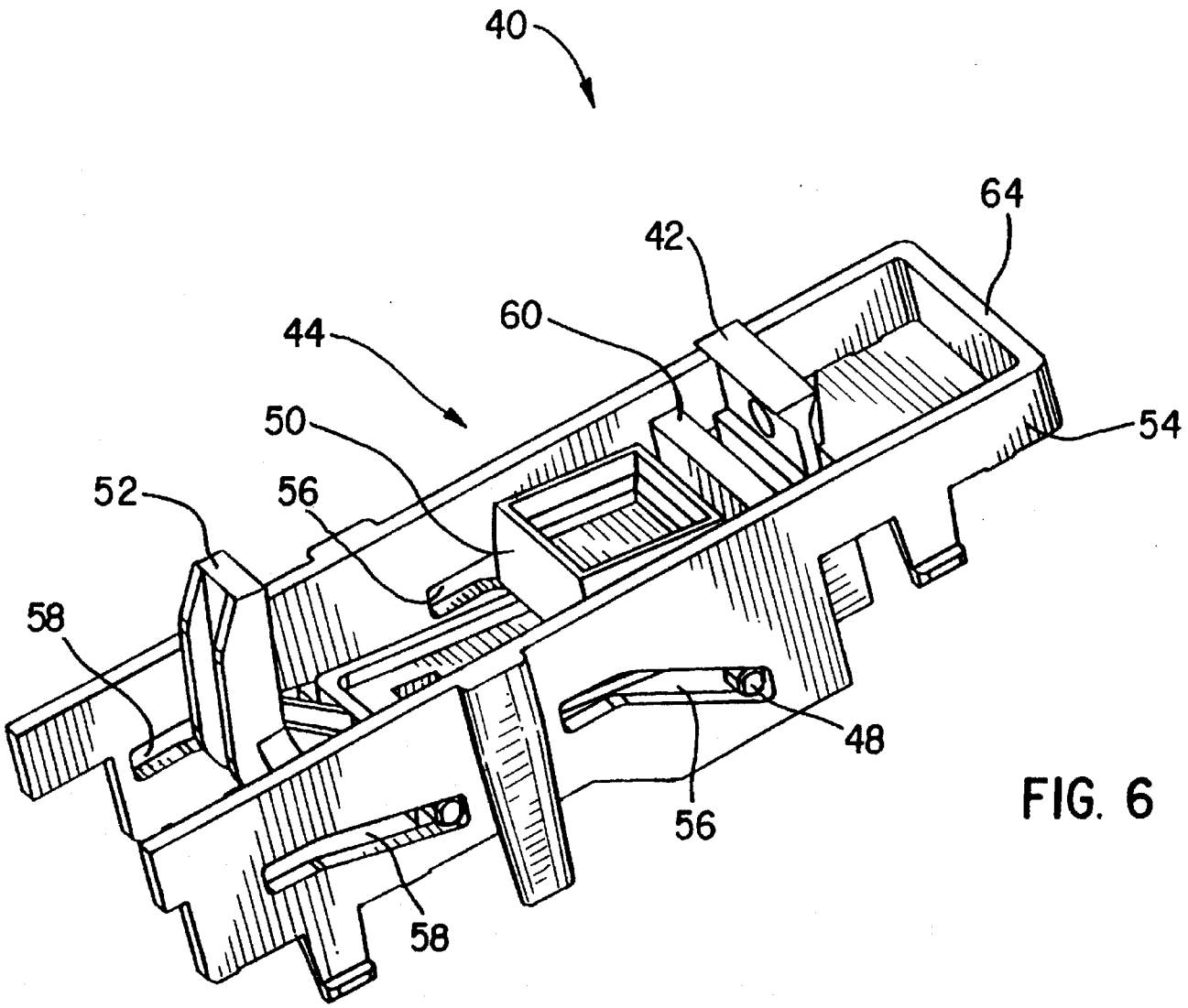
FIG. 6 is a perspective view of the maintenance device in its recessed position.
Figure 7:
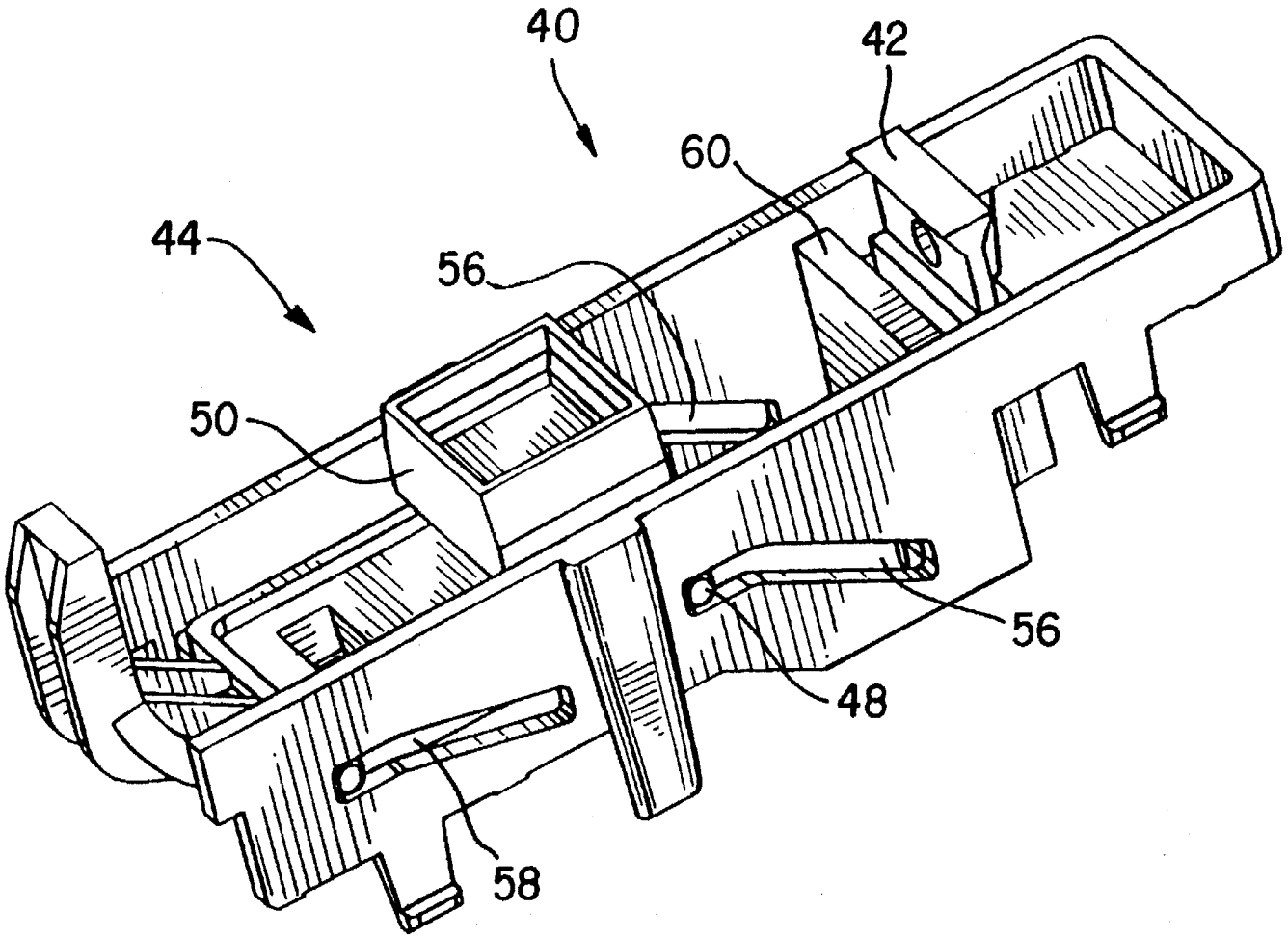
FIG. 7 is a perspective view of the maintenance device in its engaged position.

Referring to FIG. 6, a cover 54 surrounds the components of the maintenance device 40. In each side, the cover 54 includes a first guide slot 56 and a second guide slot 58. The guide pins 48 are adapted to move in guide slots 56, 58 so that the first and second guide slots 56, 58 and the guide pins 48 operate in a cam and a cam follower like manner. When the printing carriage 24 moves into the maintenance area MA, the printing carriage 24 abuts the printing carriage engaging member 52, which moves the cap carriage 46 with the guide pins 48 sliding in the guide slots 56, 58. Because the guide slots are inclined, movement of the cap carriage 46 shifts the movable cap carriage 46 between a recessed (uncapped) position (FIG. 6) and an engaged (capped) position (FIG. 7). The maintenance device 40 also includes a retaining wall 60 (FIG. 6) preferably integral with the cover 54 and disposed between the wiper 42 and the capping mechanism 44 (discussed below).

In operation, when printing is completed, the printing carriage 24 is shifted from the printing area PA to the maintenance area MA. When the printing carriage 24 engages the printing carriage engaging member 52, the movable cap carriage 46 is moved toward the end of the printing apparatus (toward the left in FIG. 6) by the movement of the printing carriage 24.

Figure 8:
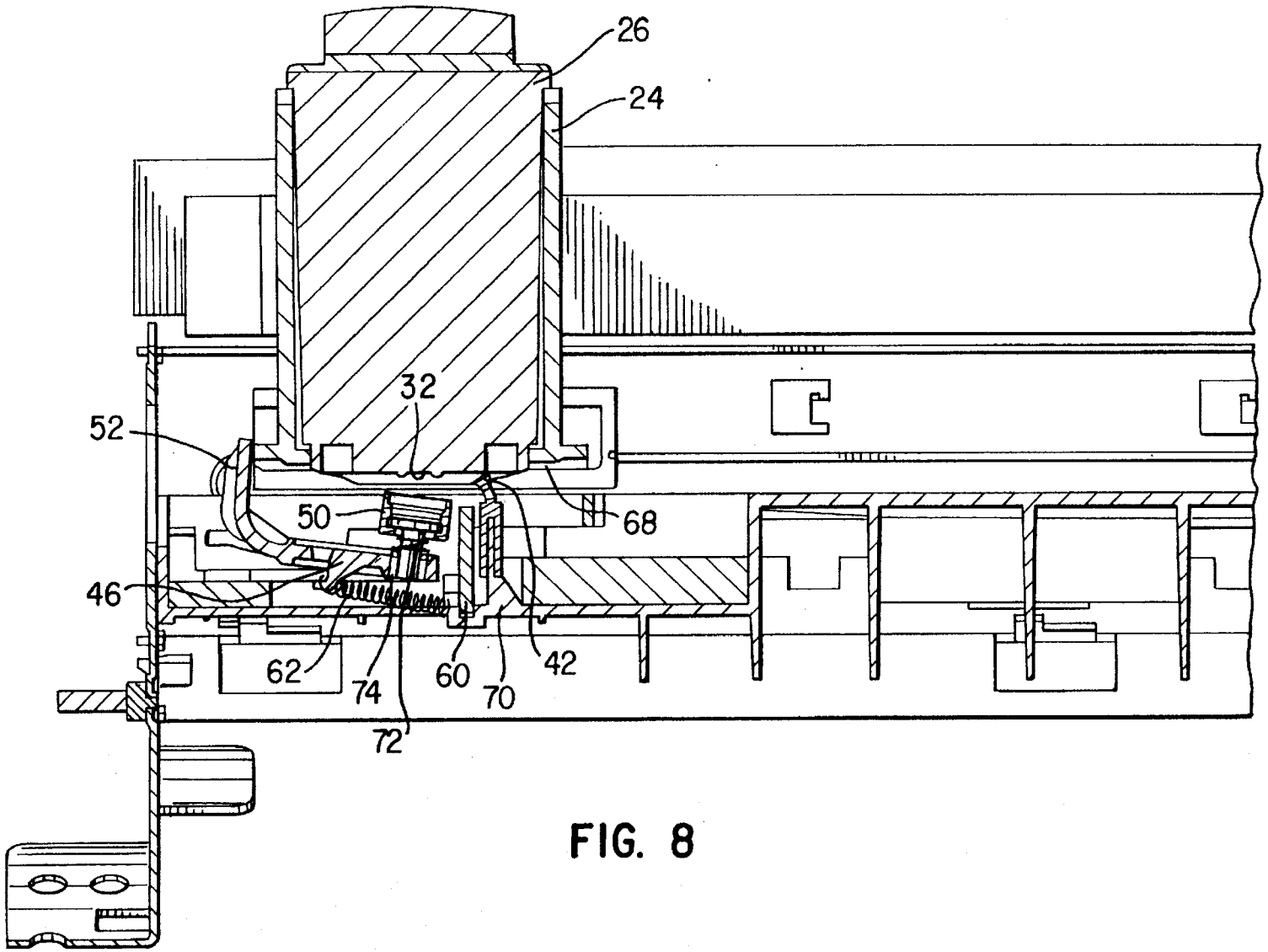
FIG. 8 is a cross sectional view through the printing carriage of the printing apparatus, illustrating the components of the maintenance device.

Because of the guide pins 48 engaging the guide slots 56 and 58, the movable cap carriage 46 is caused to lift and rotate from the recessed position illustrated in FIGS. 6 and 8 to the engaged position illustrated in FIGS., 7 and 9. In the engaged position, cap 50 completely covers the nozzles of the ink jet head 32.

In an effort to minimize the space occupied by the maintenance device 40, the angle of incline of the guide slots 56 and 58 should be as steep as possible so as to raise the capping mechanism 44 in the shortest possible lateral distance. A problem arises, however, in that if the slope of the guide slots 56 and 58 is too steep, the frictional resistance of guide pins 48 in the slots 56 and 58 is high. Accordingly, in the present invention, the angle of incline of the second guide slot 58 is made relatively small to minimize the frictional resistance of its guide pin 48. On the other hand, the first guide slot 56 receiving the pin 48 adjacent the cap 50 is made steeper such that the cap 50 is disposed below a top surface 64 of the maintenance device cover 54 in the recessed position (FIGS. 6 and 8). When the printing carriage 24 engages the printing carriage engaging member 52 and is moved from the printing area PA to the maintenance area MA, the cap carriage 46 is shifted and rotated into the engaged position (FIGS. 7 and 9), engaging the ink jet head 32 of the ink jet printing apparatus.

Figure 9:
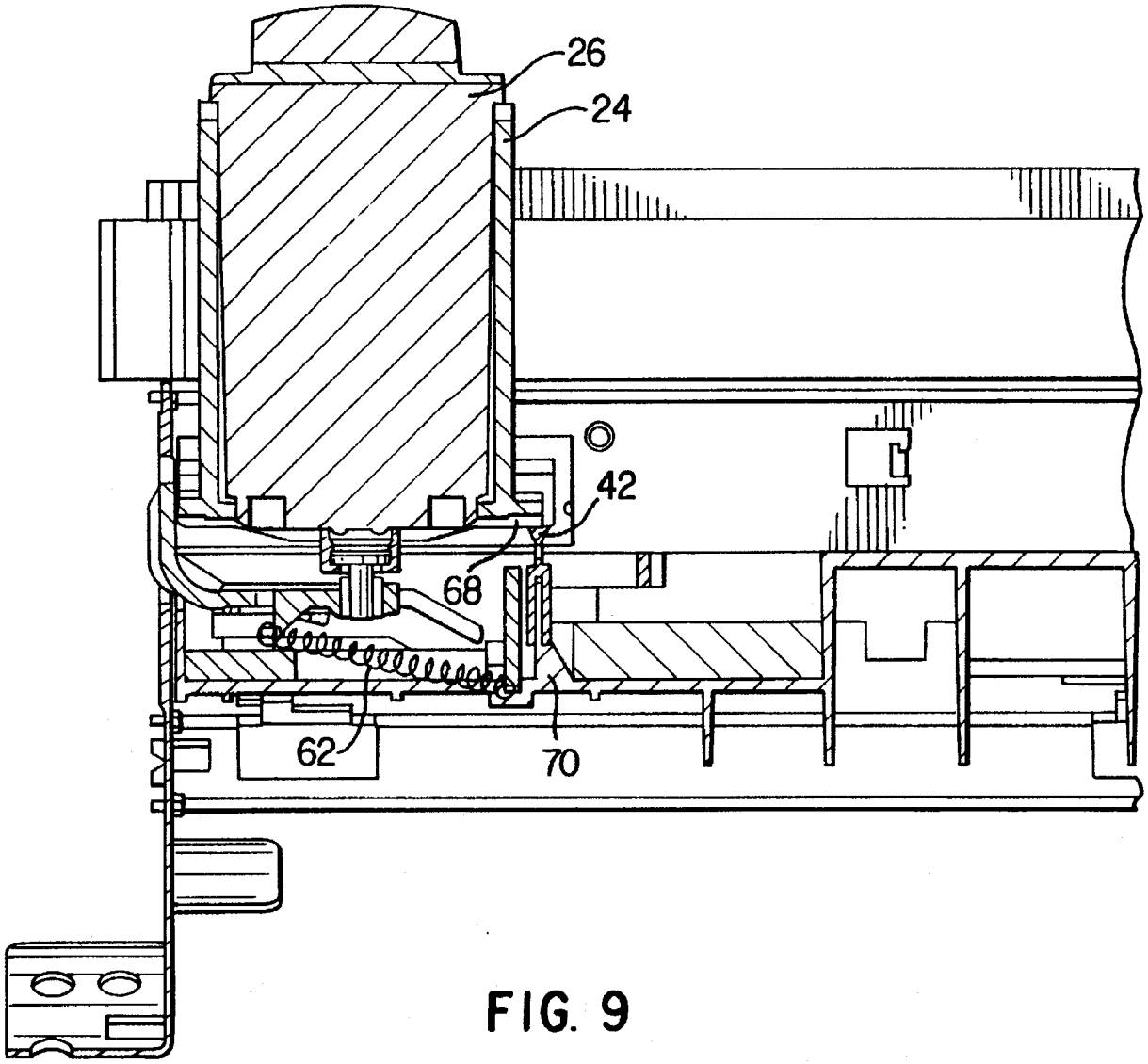
FIG. 9 is a cross sectional view, illustrating the maintenance device in its engaged position.

Referring to FIGS. 8 and 9, the maintenance device 40 is fixed to the printing apparatus in a maintenance device frame 70. The wiper 42 is fixed to the frame 70 by any suitable securing means. In operation, when the ink jet head 32 is wiped by the wiper 42, the wiper 42 may be deflected slightly toward the maintenance area MA. As a result, after repeated uses, the wiper 42 may be permanently deflected. The retaining wall 60 prevents the wiper 42 from deflecting beyond a predetermined position, thus preventing this permanent deflection. The retaining wall 60 is preferably formed of a rigid material such as plastic and therefore has greater rigidity than the wiper 42.

In addition, in the event that the wiper 42 is deflected by the print head 32, there may be an instance where the wiper blade 42 is caught between the cap 50 and the ink jet head 32 (see, for example, FIG. 3 of U.S. Pat. No. 5,202,702 to Terasawa discussed above). The retaining wall 60 prevents the wiper 42 from being deflected into the path of the capping mechanism 44. Therefore, even though the wiper 42 is disposed very near the capping mechanism 44 to minimize the maintenance area MA, an interference between the cap 50 and the wiper 42 is avoided.

The printing carriage 24 and the print cartridge 26 are disposed such that an end portion of the print cartridge 26 extends outside of (below in FIG. 8) the printing carriage 24 forming a stepped area 68 adjacent the printing carriage 24. Referring to FIG. 9, in the engaged position, the wiper 42 is disposed in the stepped area 68 such that there is a clearance between the wiper 42 and the printing carriage 24. The stepped area 68 enables the wiper blade 42 to fully recoil from any deflection caused during wiping of the ink jet head 32. As a result, the wiper 42 is prevented from becoming permanently deflected, thereby extending the life of the wiper 42. In addition, the stepped area 68 ensures that residual ink that is wiped from the ink jet head 32 is separated from the printing carriage 24 and print cartridge 26 into the maintenance device 40. Accordingly, the wiper 42 can be disposed below the carriage 24 without any problem when the carriage is in the maintenance area MA. This structure further minimizes the space for the maintenance device 40, while maximizing the amount of space available for printing.

If the printing carriage 24 and the print cartridge 26 were not configured to form the stepped area 68, the deflected wiper 42 would give the print cartridge 26 great frictional resistance when the printing carriage 24 is shifted from the maintenance area MA to the printing area PA for printing. Further, residual ink that is wiped from the ink jet head 32 by the wiper 42 may dry on the printing carriage 24, causing the ink to be dropped on a paper during a subsequent printing operation. An ink buildup on the printing carriage 24 and/or the wiper 42 would significantly reduce the efficiency of the maintenance device.

Figure 10:
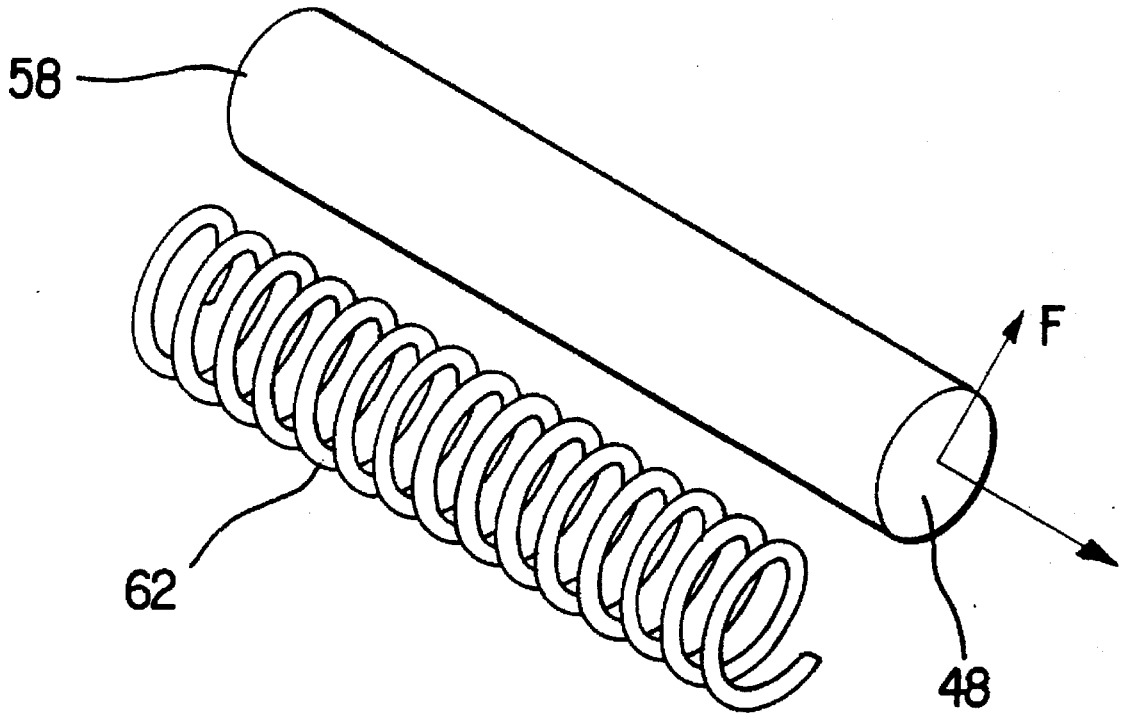
FIG. 10 is a conceptual illustration, illustrating force components of a spring in the maintenance device.

Referring to FIGS. 8 and 10, a spring 62 is disposed between the movable cap carriage 46 and a base portion of the wall 60. The spring 62 is a compression spring, urging the movable cap carriage 46 toward the recessed position. When the printing carriage 24 is shifted from the maintenance area MA to the printing area PA for printing, the spring 62 causes the movable cap carriage 46 to shift from the engaged position (FIG. 9) to the recessed position (FIG. 8). The spring 62 is fixed so as to be disposed at an angle between the angles of the second guide slot 58 and the first guide slot 56, and preferably substantially corresponding to the angle of the second guide slot 58. As a result, substantially all of the force of the spring 62.will be directed along the axis of the second guide slot 58. In other words, referring to FIG. 10, force components F of the spring directed toward the edges of the slots will be minimized, thus further reducing friction of the pins 48 in the slots 56, 58.

In an alternative arrangement, the cap 50 is telescopically slidable in an aperture 74 through the cap carriage 46. A spring 72 is disposed between the cap carriage 46 and the cap 50. As a result, when the cap carriage 46 is shifted into the engaged (capped) position, the spring 72 is compressed against the cap carriage 46, causing the cap 50 to seal around the ink jet head 32 with a positive capping force.

While the embodiments described herein are preferred, it will be appreciated from the specification that various alternatives, modifications, variations or improvements therein may be made by those skilled in the art that are within the scope of the invention, which is defined by the following claims.

What is claimed is:

1. A maintenance device in an ink jet printing apparatus, the maintenance device comprising:

a movable cap carriage supporting a cap and including a first guide pin and a second guide pin, wherein said cap is engageable with an ink jet head of said ink jet printing apparatus; and a guide member including a first guide slot and second guide slot guiding said first guide pin and said second guide pin of said cap carriage, respectively, wherein said first guide slot and said second guide are inclined at different angle with respect to each other.

2. The maintenance device as claimed in claim 1, wherein said cap carriage is movable between a recessed position and an engaged position by said first guide pin and said second guide pin in said first guide slot and said second guide slot, wherein said first guide slot is configured such that said cap is disposed clear of a printing carriage path in said recessed position.

3. The maintenance device as claimed in claim 1, wherein said first guide slot is inclined at a steeper angle than said second guide slot such that said cap carriage is shifted and rotated between said recessed position and said engaged position.

4. The maintenance device as claimed in claim 1, wherein said cap is disposed substantially in alignment with said first guide pin.

5. The maintenance device as claimed in claim 1, wherein said movable cap carriage further comprises third and fourth guide pins, and wherein said guide member further comprises third and fourth guide slots receiving said third and fourth guide pins.

6. The maintenance device as claimed in claim 1, wherein said cap is telescopically slidable in an aperture through said movable cap carriage, and wherein a spring is disposed between said cap and said movable cap carriage, said spring causing said cap to seal around said ink jet head with a positive capping force when said cap is engaged with said ink jet head.

7. An ink jet printing apparatus comprising:

a printing carriage that is movable between a maintenance area and a printing area;

a maintenance device including:

a cap carriage movable between a recessed position and an engaged position and supporting a cap, said cap carriage including first and second guide pins, wherein said cap covers an ink jet head of said ink jet printing apparatus in said engaged position, a printing carriage engaging member attached to said cap carriage, said printing carriage engaging member engaging said printing carriage when said printing carriage moves between said printing area and said maintenance area, and a guide member including first and second guide slots receiving said first and second guide pins of said cap carriage, respectively; and a spring, one end of said spring fixed to a stationary portion of said ink jet printing apparatus and the other end of said spring fixed to said cap carriage for movement with said cap carriage, wherein said spring is disposed at an angle substantially corresponding to an incline angle of one of said first and second guide slots.

8. The ink jet printing apparatus as claimed in claim 7, wherein a first of said first and second guide slots is configured such that said cap is disposed clear of a printing carriage path in said recessed position.

9. The ink jet printing apparatus as claimed in claim 7, wherein a first of said first and second guide slots is inclined at a steeper angle than an incline angle of a second of said first and second guide slots such that said cap carriage is shifted and rotated between said recessed position and said engaged position.

10. The ink jet printing apparatus as claimed in claim 7, wherein said spring urges said cap carriage toward said recessed position.

11. The maintenance device as claimed in claim 7, wherein said cap is telescopically slidable in an aperture through said movable cap carriage, and wherein a spring is disposed between said cap and said movable cap carriage, said spring causing said cap to seal around said ink jet head with a positive capping force in said engaged position.

12. A maintenance device in an ink jet printing apparatus, the maintenance device comprising:

a movable cap carriage supporting a cap, wherein said cap is engageable with an ink jet head of said ink jet printing apparatus;

means for shifting said cap carriage between a recessed position and an engaged position said means for shifting including means for reducing frictional resistance during shifting, wherein said cap covers an ink jet head of said ink jet printing apparatus in said engaged position ; and a guide member cooperable with the cap carriage, wherein said shifting means and said reducing means comprises a plurality of guide pins fixed to a first of said cap carriage and said guide member and a corresponding plurality of guide slots formed in a second of said cap carriage and said guide member, said guide slots receiving said guide pins, wherein said guide slots are inclined at different angles with respect to each other.

13. The maintenance device as claimed in claim 12, wherein a first of said guide slots is configured such that said cap is disposed clear of a printing carriage path in said recessed position.

14. The maintenance device as claimed in claim 12, wherein a first of said guide slots is inclined at a steeper angle than a second of said guide slots such that said cap carriage is shifted and rotated between said recessed position and said engaged position.

15. The maintenance device as claimed in claim 13, wherein said shifting and reducing means comprises:

at least one slot having an incline angle;

at least one pin fixed to said movable cap carriage, said at least one slot receiving said pin; and a second spring attachable between said movable cap carriage and a stationary portion of said ink jet printing apparatus, said spring being disposed at an angle substantially corresponding to said incline angle of said at least one slot.

16. The maintenance device as claimed in claim 12, wherein said cap is telescopically slidable in an aperture through said movable cap carriage, and further wherein a spring is disposed between said cap and movable cap carriage, said spring causing said cap to seal around said ink jet head with a positive capping force in said engaged position.

* * * * *